US009809024B2

(12) United States Patent
Hashimoto

(10) Patent No.: US 9,809,024 B2
(45) Date of Patent: Nov. 7, 2017

(54) IMAGE FORMING APPARATUS

(71) Applicant: Kenichiroh Hashimoto, Kanagawa (JP)

(72) Inventor: Kenichiroh Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/166,988

(22) Filed: May 27, 2016

(65) Prior Publication Data

US 2016/0361919 A1 Dec. 15, 2016

(30) Foreign Application Priority Data

Jun. 11, 2015 (JP) ..... 2015-118687
Apr. 15, 2016 (JP) ..... 2016-082372

(51) Int. Cl.

| | |
|---|---|
| ***B41J 2/21*** | (2006.01) |
| ***B41J 2/145*** | (2006.01) |
| ***B41J 11/00*** | (2006.01) |
| ***B41J 2/045*** | (2006.01) |

(52) U.S. Cl.

CPC ..... *B41J 2/145* (2013.01); *B41J 2/04581* (2013.01); *B41J 2/04593* (2013.01); *B41J 2/04596* (2013.01); *B41J 2/2114* (2013.01); *B41J 2/2117* (2013.01); *B41J 11/0015* (2013.01)

(58) Field of Classification Search

CPC ..... B41J 2/2114; B41J 2/2117; B41J 2/211; B41J 2/2132; B41J 2/155; B41J 2/5056; B41J 2/24; B41J 2/25; B41J 2/265; B41J 11/0015; B41J 2202/20

See application file for complete search history.

(56) References Cited

U.S. PATENT DOCUMENTS

| | | | | |
|---|---|---|---|---|
| 6,086,185 | A * | 7/2000 | Inui | B41J 2/2132 347/43 |
| 6,367,914 | B1 | 4/2002 | Ohtaka et al. | |
| 2002/0175980 | A1 | 11/2002 | Hashimoto et al. | |
| 2004/0104985 | A1 | 6/2004 | Hashimoto et al. | |
| 2004/0246292 | A1 | 12/2004 | Hashimoto et al. | |
| 2005/0219321 | A1 | 10/2005 | Hashimoto et al. | |

(Continued)

FOREIGN PATENT DOCUMENTS

| | | |
|---|---|---|
| JP | 11-138864 | 5/1999 |
| JP | 2005-144749 | 6/2005 |

(Continued)

*Primary Examiner* — Sharon A Polk

(74) *Attorney, Agent, or Firm* — Oblon, McClelland, Maier & Neustadt, L.L.P.

(57) ABSTRACT

An image forming apparatus is provided. The image forming apparatus includes a recording head to discharge a liquid on a recording medium while scanning in a main scanning direction and a sub-scanning direction relative to the recording medium. The recording head includes a first nozzle array and a second nozzle array. The first nozzle array discharges the liquid in a first discharge amount per unit time per unit length in a longitudinal direction. The second nozzle array discharges the liquid in a second discharge amount per unit time per unit length in the longitudinal direction. The second nozzle array is shorter than the first nozzle array in the longitudinal direction and disposed not overlapped with the first nozzle array in the main scanning direction. The second discharge amount is larger than the first discharge amount.

7 Claims, 19 Drawing Sheets

(56) References Cited

U.S. PATENT DOCUMENTS

| | | | | |
|---|---|---|---|---|
| 2005/0231561 | A1 | 10/2005 | Hashimoto | |
| 2005/0264617 | A1 | 12/2005 | Nishimura et al. | |
| 2006/0238579 | A1 | 10/2006 | Hashimoto et al. | |
| 2007/0165078 | A1 | 7/2007 | Hashimoto | |
| 2007/0188547 | A1* | 8/2007 | Kobayashi | B41J 2/2114 347/37 |
| 2007/0229600 | A1 | 10/2007 | Hashimoto | |
| 2007/0247026 | A1 | 10/2007 | Tsukamura et al. | |
| 2007/0257968 | A1 | 11/2007 | Hashimoto et al. | |
| 2008/0259115 | A1* | 10/2008 | Yamaguchi | B41J 2/16532 347/30 |
| 2008/0309734 | A1 | 12/2008 | Nishimura et al. | |
| 2009/0102907 | A1 | 4/2009 | Yamanaka et al. | |
| 2010/0020130 | A1 | 1/2010 | Hashimoto | |
| 2010/0053269 | A1 | 3/2010 | Fujii et al. | |
| 2010/0245490 | A1 | 9/2010 | Tsukamura et al. | |
| 2013/0147887 | A1 | 6/2013 | Kimura et al. | |
| 2013/0241990 | A1 | 9/2013 | Shimoda et al. | |
| 2014/0055527 | A1 | 2/2014 | Hashimoto | |

FOREIGN PATENT DOCUMENTS

| | | | |
|---|---|---|---|
| JP | 2007-050555 | | 3/2007 |
| WO | WO2005/105452 | A1 | 11/2005 |

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application Nos. 2015-118687 and 2016-082372, filed on Jun. 11, 2015 and Apr. 15, 2016, respectively, in the Japan Patent Office, the entire disclosure of each of which is hereby incorporated by reference herein.

BACKGROUND

Technical Field

The present disclosure relates to an image forming apparatus.

Description of the Related Art

A print technology is known in which a background is first formed with white ink and an image is formed on the background with yellow, magenta, cyan, and/or black inks.

SUMMARY

In accordance with some embodiments of the present invention, an image forming apparatus is provided. The image forming apparatus includes a recording head to discharge a liquid on a recording medium while scanning in a main scanning direction and a sub-scanning direction relative to the recording medium. The recording head includes a first nozzle array and a second nozzle array. The first nozzle array discharges the liquid in a first discharge amount per unit time per unit length in a longitudinal direction. The second nozzle array discharges the liquid in a second discharge amount per unit time per unit length in the longitudinal direction. The second nozzle array is shorter than the first nozzle array in the longitudinal direction and disposed not overlapped with the first nozzle array in the main scanning direction. The second discharge amount is larger than the first discharge amount.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
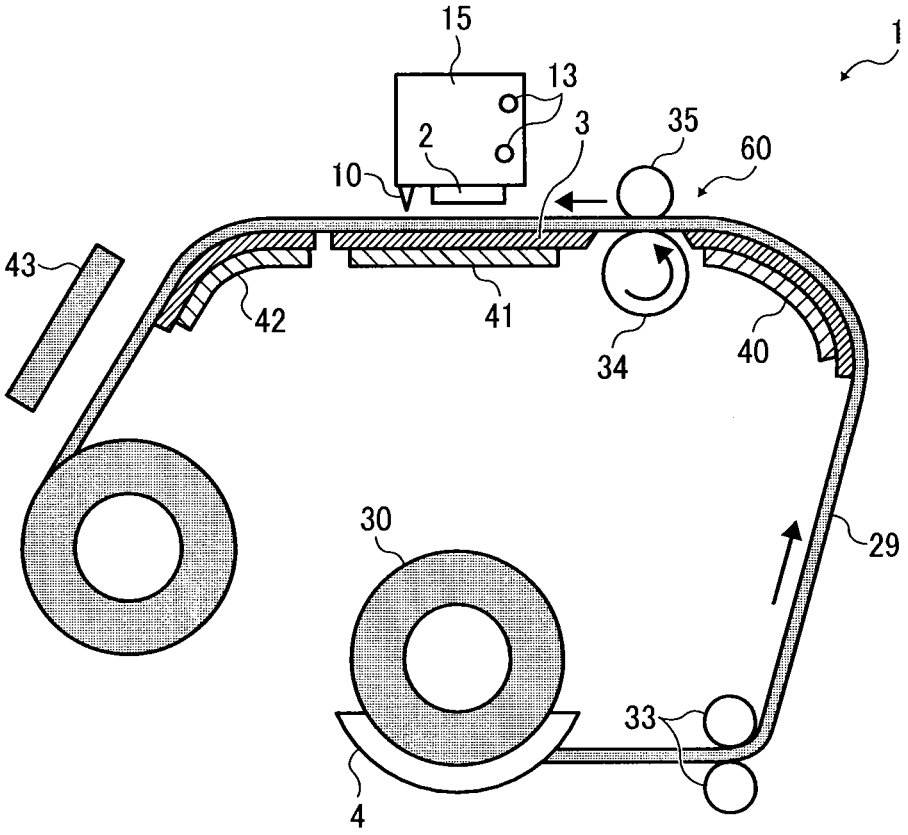
FIG. 1 is a schematic cross-sectional view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the known print technology in which a background is formed with white ink and an image is formed with yellow, magenta, cyan, and/or black inks (hereinafter "YMCK inks") on the background, a background forming nozzle array for discharging the white ink and an image forming nozzle array for discharging the YMCK inks have the same length and they are out of alignment in the sub-scanning direction. Therefore, the carriage mounting the background forming nozzle array and the image forming nozzle array is increased in size in the sub-scanning direction. As the carriage is increased in size, the platen opposing the carriage also needs to be increased in length in the sub-scanning direction.

In accordance with some embodiments of the present invention, a compact image forming apparatus is provided.

In a case in which the background forming nozzle array is disposed upstream from the image forming nozzle array relative to the sub-scanning direction, for the purpose of discharging the white ink for forming a background before discharging the YMCK inks for forming an image, the carriage is increased in size in the sub-scanning direction. In view of this situation, the inventor of the present invention has reached an image forming apparatus including a carriage including a background forming nozzle array in which the carriage has been decreased in size.

An image forming apparatus according to an embodiment of the present invention is described in detail below with reference to FIG. 1.

FIG. 1 is a schematic cross-sectional view of an image forming apparatus according to an embodiment of the present invention, which is an inkjet recording apparatus 1.

The inkjet recording apparatus 1 is a serial type inkjet recording apparatus. The apparatus body includes a recording head 2, a platen 3, a roll media storage 4, and rollers 33.

A sheet-like recording medium 29, drawn from a roll-like recording medium 30 stored in the roll media storage 4, is conveyed to immediately below a carriage 15. The distance of conveyance of the recording medium 29 corresponds to a predetermined number of passes, i.e., the lengths of background forming nozzle arrays to be described later, and does not correspond to the length of the carriage 15.

On a downstream side of the recording head 2 mounted on the carriage 15 relative to the direction of conveyance of the recording medium 29, a cutter 10 (serving as a cutter 213) to be described later) for cutting the recording medium 29 is disposed. Upon completion of a printing operation, the cutter 10 moves up and down to cut the recording medium 29.

The recording head 2 includes side plates and guide rods 13 that are bridging the side plates. The carriage 15 is slidably supported by the guide rods 13 in the main scanning direction that is vertical to the surface of the paper on which FIG. 1 is drawn (printed).

The carriage 15 includes the recording head 2 that discharges droplets of black (K), yellow (Y), magenta (M), cyan (C), and white (W) inks. The recording head 2 is integrally equipped with a sub tank for supplying inks to the recording head 2.

An encoder sheet for detecting the main scanning position of the carriage 15 is disposed along the main scanning direction of the carriage 15. The encoder sheet is read by an encoder sensor mounted on the carriage 15.

In a recording region within the main scanning region of the carriage 15, the recording medium 29 is intermittently conveyed in the sub-scanning direction that is perpendicular to the main scanning direction of the carriage 15 by a sheet sucking conveyer. The carriage 15 includes a sensor that optically detects an end of the recording medium 29. The sensor detects an end of the recording medium 29 while the carriage 15 is moving, and calculates the position of the end of the recording medium 29 in the main scanning direction and the width of the recording medium 29.

The roll media storage 4, serving as a sheet feeder, is storing the roll-like recording medium 30 in the present embodiment. According to another embodiment, the roll media storage 4 may store multiple roll-like media having different widths.

A conveyer 60 includes a feed roller 34 and a press roller 35 facing each other in the vertical direction with the platen 3 therebetween. As the feed roller 34 rotates in a direction indicated by arrow in FIG. 1 while the feed roller 34 and the press roller 35 are sandwiching the recording medium 29, the recording medium 29 is conveyed forward on the platen 3.

On an upstream side of the platen 3 relative to the direction of conveyance of the recording medium 29, a preheater 40 is disposed. The preheater 40 preliminarily heats the recording medium 29. In proximity to the platen 3, a print heater 41 (serving as a dryer 212 to be described later) is disposed. The print heater 41 heats the recording medium 29 on which ink droplets injected from the nozzles of the recording head 2 have impacted. On a downstream side of the platen 3 relative to the direction of conveyance of the recording medium 29, a post heater 42 is disposed. The post heater 42 continuously heats the recording medium 29 to accelerate drying of the ink droplets impacted thereon.

On a downstream side of the post heater 42 relative to the direction of conveyance of the recording medium 29, a hot air fan 43 is disposed. The hot air fan 43 blasts hot air to the recorded surface of the recording medium 29 on which the ink has impacted. The hot air fan 43 directly brings hot air into contact with the ink on the recorded surface of the recording medium 29, thereby reducing the humidity of the atmosphere around the recorded surface and completely drying the ink.

Each of the preheater 40, print heater 41, and post heater 42 may be an electrothermal heater using ceramic or nichrome wires.

Since the recording apparatus according to the present embodiment includes a dryer, the recording apparatus can print images on ink-impermeable recoding media, such as vinyl chloride, PET (polyethylene terephthalate), and acrylic polymer. Both solvent-based inks and aqueous resin-based inks containing resins as major components are well fixable on such ink-impermeable recoding media.

In the inkjet recording apparatus, the carriage 15 discharges ink while reciprocating in the width direction (i.e., the main scanning direction) of the recording medium 29, thereby forming an image. The inkjet recording apparatus is capable of performing either one-way printing or two-way printing. In one-way printing, the carriage 15 discharges ink to form an image only when moving forward. In two-way printing, the carriage 15 discharges ink to form an image when moving both forward and backward. Two-way printing is advantageous in terms of print speed. Therefore, two-way printing is mainly used.

A control structure of the above-described image forming apparatus is described in detail below with reference to FIGS. 2A and 2B.

Figure 2A:
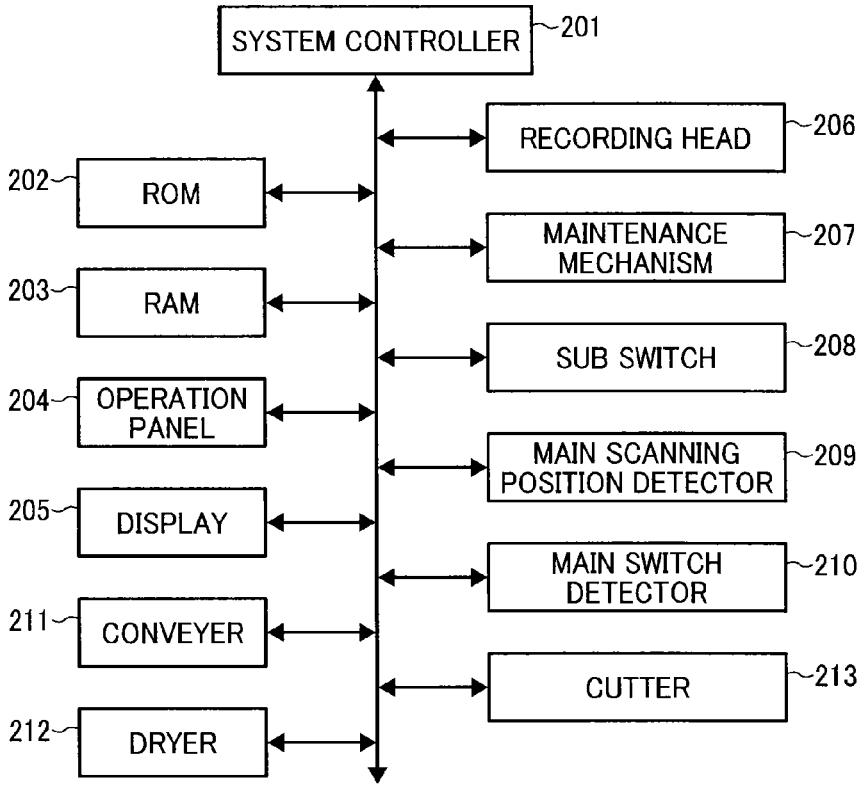
FIGS. 2A and 2B are a hardware block diagram and a functional block diagram, respectively, of the image forming apparatus illustrated in FIG. 1.
Figure 2B:
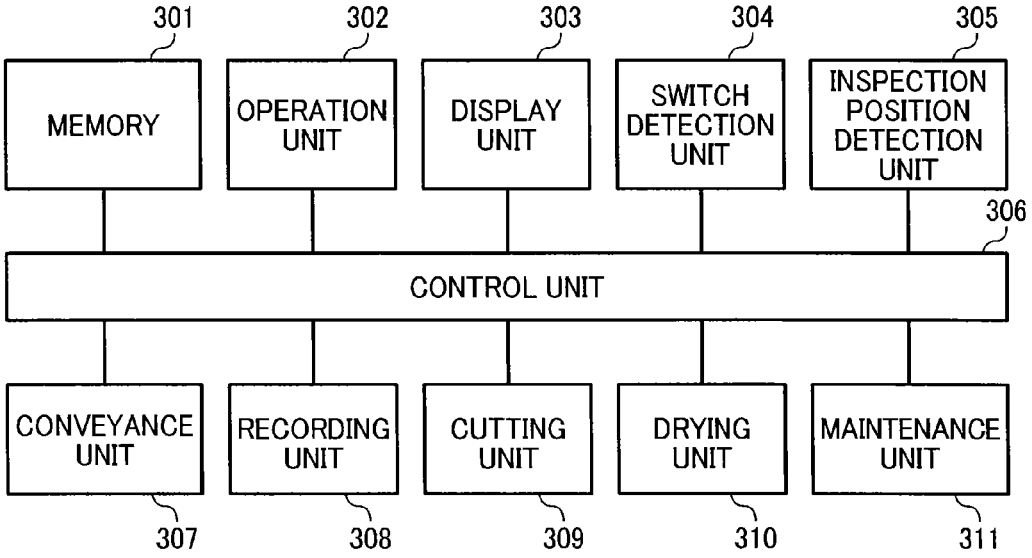

FIGS. 2A and 2B are a hardware block diagram and a functional block diagram, respectively, of the image forming apparatus according to an embodiment of the present invention.

Referring to FIG. 2A, the image forming apparatus includes a system controller 201, a read only memory (ROM) 202, a random access memory (RAM) 203, an operation panel 204, a display 205, a recording head 206, a maintenance mechanism 207, a sub switch 208, a main scanning position detector 209, a main switch detector 210, a conveyer 211, a dryer 212, and a cutter 213.

The system controller 201 controls each part of the apparatus to operate the overall image forming apparatus. The system controller 201 is implemented as a calculator, such as a central processing unit (CPU), performs a calculation according to a program for operating the image forming apparatus.

The system controller 201 may be implemented not only by a single CPU but also by multiple CPUs or combinations with application specific integrated circuit (ASIC) and/or field programmable gate array (FPGA).

The ROM 202 is a nonvolatile memory medium in which the above-described program for operating the image forming apparatus is stored.

The RAM 203 is a volatile memory that is capable of reading and writing information at high speeds. The RAM 203 stores various information needed for operating the image forming apparatus and setting contents, for example, how to deal with a case in which the main switch is turned off during a printing operation.

The operation panel 204 is a user interface that allows users to operate the image forming apparatus, which may be composed of a hard button or a touch panel.

The display 205 is another user interface that displays the operation guidance and condition of the image forming apparatus and messages to users, which may be composed of a liquid crystal display element.

The recording head 206, corresponding to the recording head 2 illustrated in FIG. 1, is a device that outputs images on a recording medium.

As described above, the image forming apparatus according to an embodiment of the present invention is an inkjet recording apparatus that outputs images on a recording medium as the recording head 206 discharges ink to the recording medium.

The maintenance mechanism 207 cleans the recording head 206 for maintenance.

The sub switch 208 is a relay that is controlled by the system controller 201. The sub switch 208 opens and closes a current path from a commercial power at the time when a manual main switch is turned off. Namely, the sub switch 208 functions as a power supply switcher. The sub switch 208 may also be composed of a transistor. The main scanning position detector 209 detects the position of the recording head 206 in the main scanning direction. The main switch detector 210 detects the on/off condition of the main switch that is manually switchable.

Referring to FIG. 2B, the image forming apparatus includes a memory 301, an operation unit 302, a display unit 303, a switch detection unit 304, an inspection position detection unit 305, a control unit 306, a conveyance unit 307, a recording unit 308, a cutting unit 309, a drying unit 310, and a maintenance unit 311.

The memory 301 illustrated in FIG. 2B is implemented by the ROM 202 and the RAM 203 illustrated in FIG. 2A. The operation unit 302 illustrated in FIG. 2B is implemented by the operation panel 204 illustrated in FIG. 2A. The display unit 303 illustrated in FIG. 2B is implemented by the display 205 illustrated in FIG. 2A. The switch detection unit 304 illustrated in FIG. 2B is implemented by the main switch detector 210 illustrated in FIG. 2A. The inspection position detection unit 305 illustrated in FIG. 2B is implemented by the main scanning position detector 209 illustrated in FIG. 2A. The control unit 306 illustrated in FIG. 2B is implemented by the system controller 201 illustrated in FIG. 2A. The conveyance unit 307 illustrated in FIG. 2B corresponds to the conveyer 60 illustrated in FIG. 1 and is implemented by the conveyer 211 illustrated in FIG. 2A. The recording unit 308 illustrated in FIG. 2B is implemented by the recording head 206 illustrated in FIG. 2A. The cutting unit 309 illustrated in FIG. 2B is implemented by the cutter 213 illustrated in FIG. 2A. The drying unit 310 illustrated in FIG. 2B is implemented by the dryer 212 illustrated in FIG. 2A. The maintenance unit 311 illustrated in FIG. 2B is implemented by the maintenance mechanism 207 illustrated in FIG. 2A.

In addition to the hardware components illustrated in FIG. 2A, the image forming apparatus further includes a device for acquiring detection signals from sensors and sheet conveyance rollers distributed over the entire image forming apparatus. Moreover, the image forming apparatus includes a controller for controlling mechanical devices, such as a main scanning motor for moving the carriage 15 (illustrated in FIG. 1) equipped with the recording head 206 in the main scanning direction.

Figure 3:
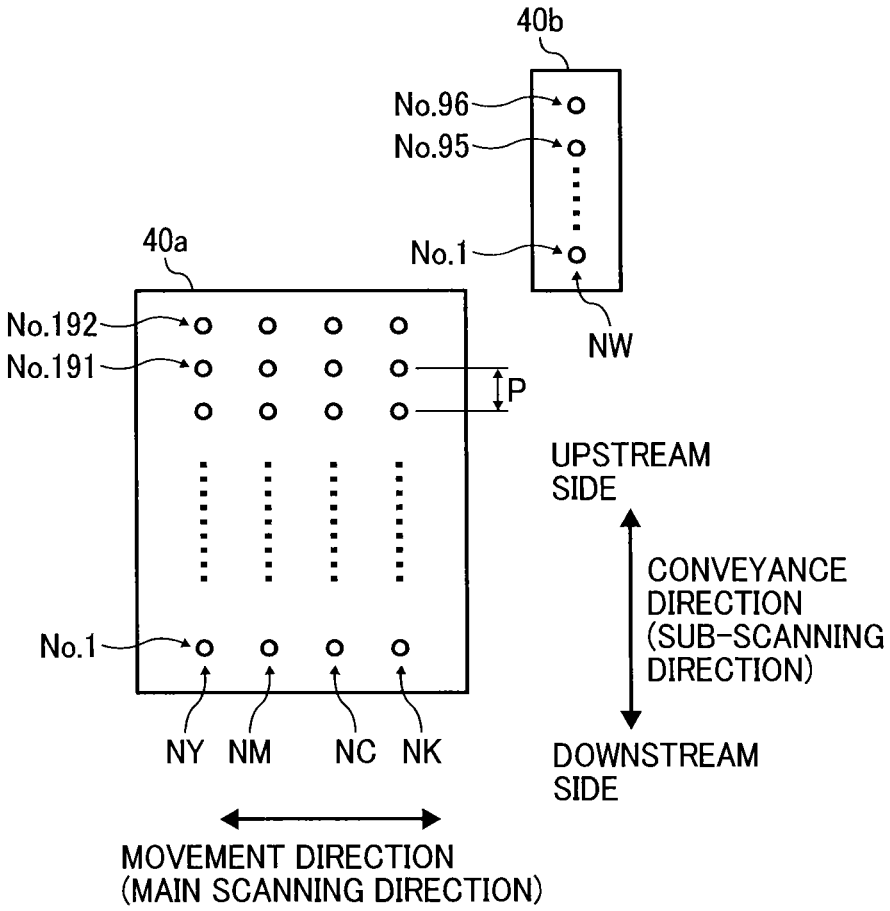
FIG. 3 is an illustration for explaining the nozzle configuration of a recording head according to an embodiment of the present invention.

FIG. 3 is an illustration for explaining the nozzle configuration of the recording head.

FIG. 3 illustrates nozzles arrays viewed through the upper surface of the recording head in a transmissive manner. An image forming recording head 40*a* includes four image forming nozzle arrays.

Each image forming nozzle array includes 192 nozzles, numbered from 1 to 192.

Referring to FIG. 3, the 192 nozzles are numbered from 1 to 192, from the downstream side to the upstream side relative to the direction of conveyance of the recording medium. The pitch P of the nozzles is 150 dpi.

The multiple image forming nozzle arrays include a nozzle array NY for injecting yellow ink Y, a nozzle array NM for injecting magenta ink M, a nozzle array NC for injecting cyan ink C, and a nozzle array NK for injecting black ink K.

A background forming recording head 40*b* includes one background forming nozzle array. The background forming nozzle array includes 96 nozzles, numbered from 1 to 96. Referring to FIG. 3, the 96 nozzles are numbered from 1 to 96, from the downstream side to the upstream side relative to the direction of conveyance of the recording medium.

Similar to the background forming recording head 40*b*, the pitch P of the nozzles is 150 dpi. As an example, the background forming nozzle array may be a white ink nozzle array NW for injecting white ink W. The background forming nozzle array is shorter than the image forming nozzle arrays in a longitudinal direction.

Operation 1

Figure 4:
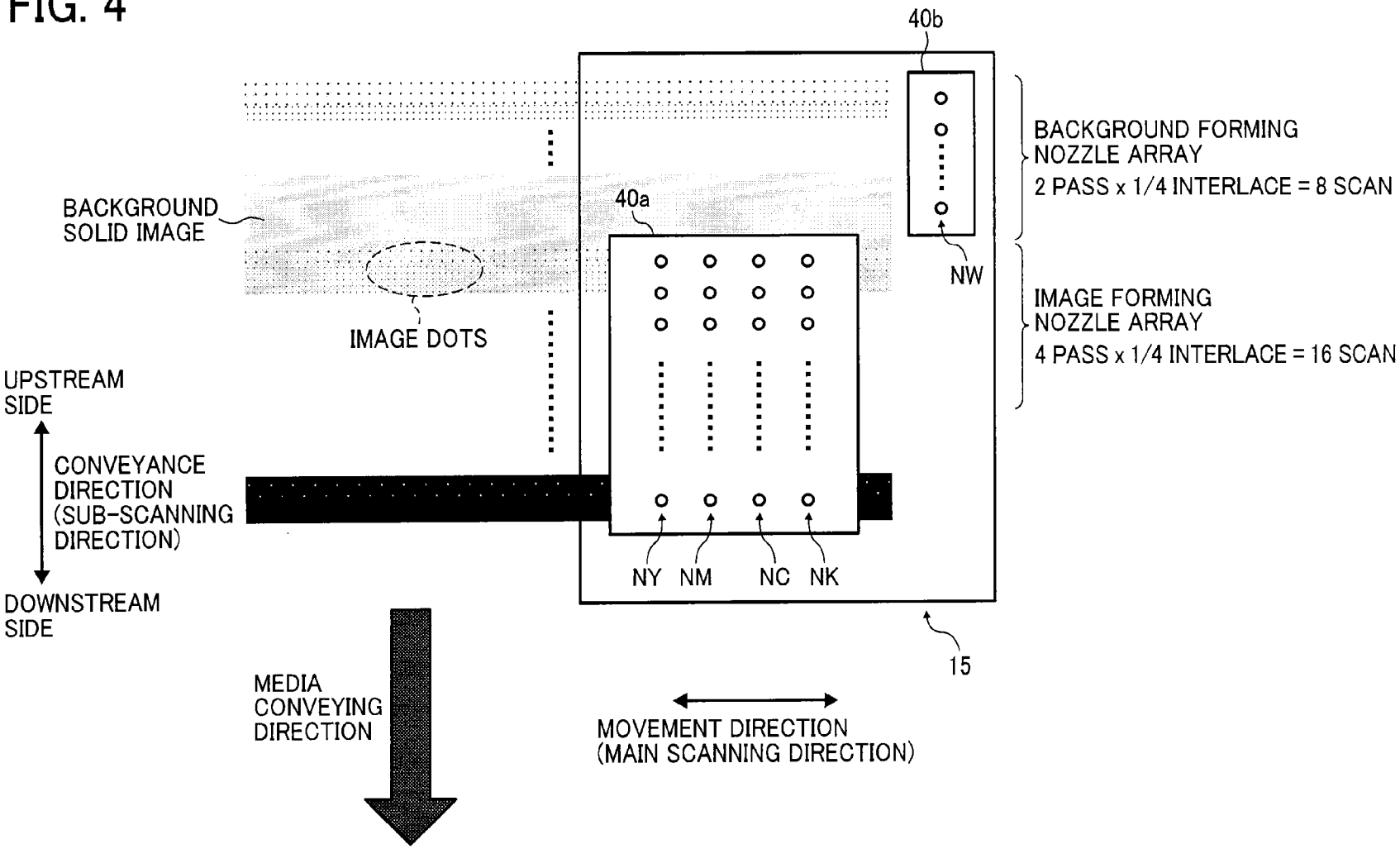
FIG. 4 is an illustration for explaining a print operation of the image forming apparatus illustrated in FIG. 1.

FIG. 4 is an illustration for explaining a print operation.

In the embodiment illustrated in FIG. 4, the length of the background forming nozzle array is half that of the image forming nozzle array. The image forming nozzle arrays and the background forming nozzle array are mounted on the image forming recording head 40*a* and the background forming recording head 40*b*, respectively. The image forming recording head 40*a* and the background forming recording head 40*b* are mounted on the carriage 15. In the present embodiment, the image forming nozzle arrays and the background forming nozzle array are mounted on separate recording heads. Alternatively, the image forming nozzle arrays and the background forming nozzle array can be mounted on a single recording head.

Since the number of nozzles in the background forming nozzle array is smaller than that in the image forming nozzle array, the droplet discharge frequency for the background forming nozzle array is twice that for the image forming nozzle array. Thus, a background can be printed with the same speed as an image is printed, although the number of the background forming nozzles is smaller than that of the image forming nozzles.

For example, when the image forming nozzle array forms an image under the condition of 4 passes, ¼ interlace, and 16 scans, the background forming nozzle array forms a background under the condition of 2 passes, ¼ interlace, and 8 scans. As the 150-dpi nozzle array performs a print operation with ¼ interlace, a 600-dpi image is formed in the sub-scanning direction.

Here, "1 pass" refers to a print operation in which all pixels are printed at once with printable color inks. Accordingly, "2 passes" refers to a situation in which an image formation in the main scanning direction is completed as the recording head has scanned twice. The "interlace" refers to a print mode in which data output in the sub-scanning direction is printed as the recording head has scanned multiple times.

The background needs to be solid, but not to be halftone and/or high-definition. Therefore, binary dots suffice for formation of the background, and multivalued dots are needless. The drive waveform can be set simple, and thus the drive frequency can be set high.

Although the background is formed with a smaller number of scanning than the image is, there is no need to take measures against color boundary blurring that never occurs in the background solid image. Therefore, a smaller number of scanning causes no problem in the resulting image.

Since the discharge frequencies for the background forming nozzle array and the image forming nozzle array are different, the amount of liquid discharged from the background forming nozzle array per unit time per unit length in the longitudinal direction (sub-scanning direction) is larger than that discharged from the image forming nozzle array per unit time per unit length in the longitudinal direction (sub-scanning direction).

As an example, a case in which the unit length is 1 cm and the unit time is 1 second is described below. The amount of ink droplets discharged from each nozzle disposed within a 1-cm longitudinal part of the image forming nozzle array within a 1-second period is defined as a first liquid discharge amount. The amount of ink droplets discharged from each nozzle disposed within a 1-cm longitudinal part of the background forming nozzle array within a 1-second period is defined as a second liquid discharge amount.

In the present embodiment, discharge operations of the image forming nozzle array and the background forming nozzle array are so controlled that the second liquid discharge amount becomes larger than the first liquid discharge amount.

In the present embodiment, the background forming nozzle array is decreased in length by reducing the number of nozzles therein. Alternatively, the background forming nozzle array can be decreased in length by reducing the pitch between nozzles without reducing the number of nozzles. Alternatively, the background forming nozzle array can be decreased in length by providing multiple nozzle arrays, as described later.

Operation 2

Methods for driving the recording heads are described below with reference to FIGS. 5 and 6.

Figure 5:
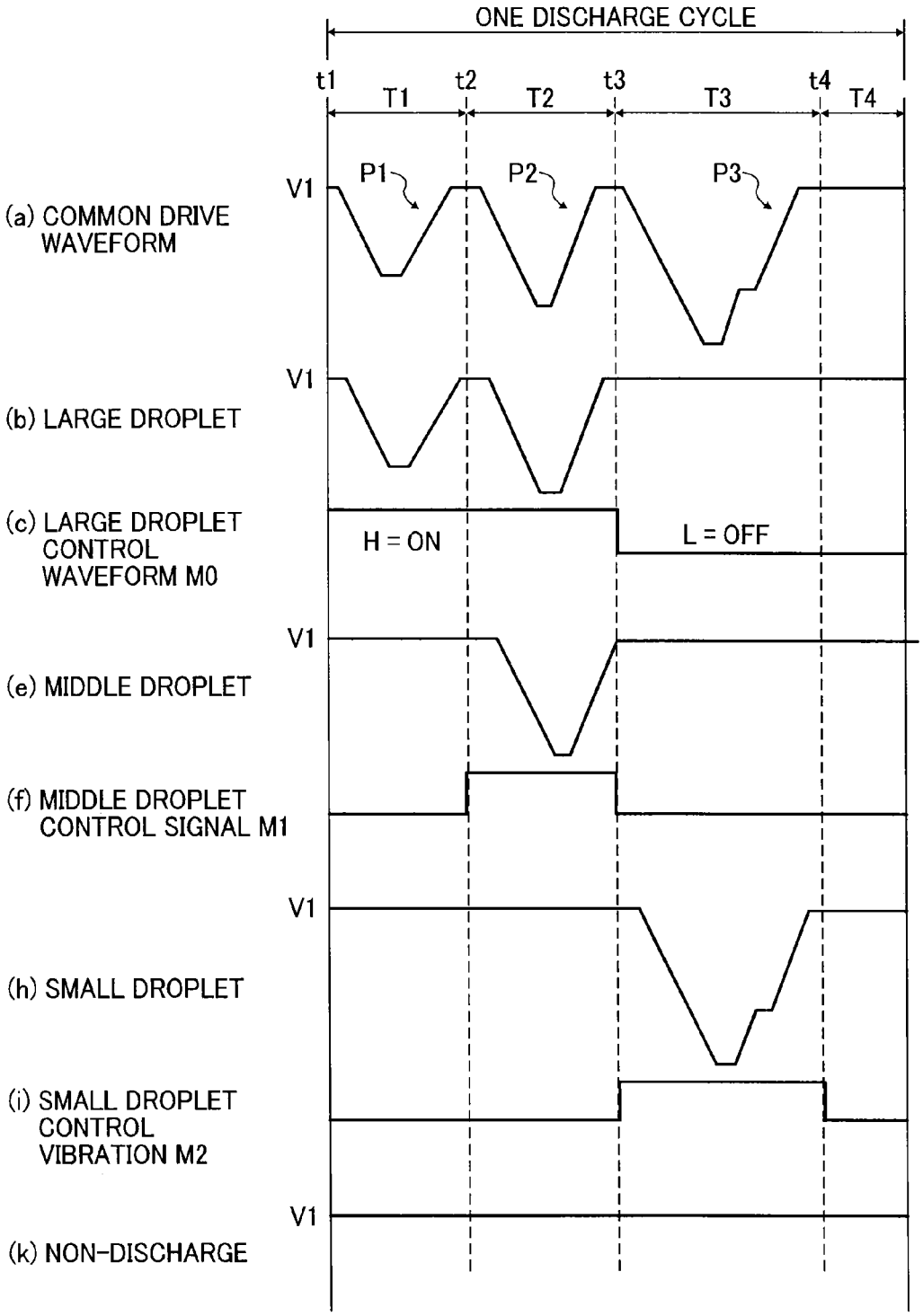
FIG. 5 is a chart illustrating a method for driving an image forming recording head according to an embodiment of the present invention.

FIG. 5 is a chart illustrating a method for driving the image forming recording head 40*a*. FIG. 6 is a chart illustrating a method for driving the background forming recording head 40*b*.

First, a method for driving the image forming recording head 40*a* is described in detail below with reference to FIG. 5.

A drive waveform generator outputs a common drive waveform including drive signals (pulses) P1, P2, and P3, in which the potential falls down from an intermediate potential (reference potential) V1 and rises up toward the reference potential V1 after a lapse of a predetermined hold time within one discharge cycle, as shown by a line chart (a). When the potential falls down, the volume of a liquid chamber expands. When the potential rises up, the volume of the liquid chamber contracts.

The pulses P1 and P2 each cause each nozzle to discharge one droplet, and the discharged two droplets coalesce with each other while flying to become a large droplet. The fallen potential in the waveform element of the pulse P2 is set lower than that in the waveform element of the pulse P1, so that the pulse P2 alone can cause each nozzle to discharge a middle droplet. The fallen potential in the waveform element of the pulse P3 is set lower than that in the waveform element of the pulse P2, and the potential is risen up in a stepwise manner in the waveform element of the pulse P3, so that the pulse P3 alone can cause each nozzle to discharge a small droplet.

When discharging large droplets, the drive waveform generator outputs a large droplet control signal M0 that becomes a high level H within intervals T1 and T2 corresponding to the pulses P1 and P2, as shown by line charts (b) and (c) in FIG. 5. When discharging middle droplets, the drive waveform generator outputs a middle droplet control signal M1 that becomes a high level within the interval T2 corresponding to the pulse P2, as shown by line charts (e) and (f) in FIG. 5.

When discharging small droplets, the drive waveform generator outputs a small droplet control signal M2 that becomes a high level within an interval T3 corresponding to the pulse P3, as shown by line charts (h) and (i) in FIG. 5.

Operation 3

Next, a method for driving the background forming recording head 40*b* is described in detail with reference to FIG. 6.

Figure 6:
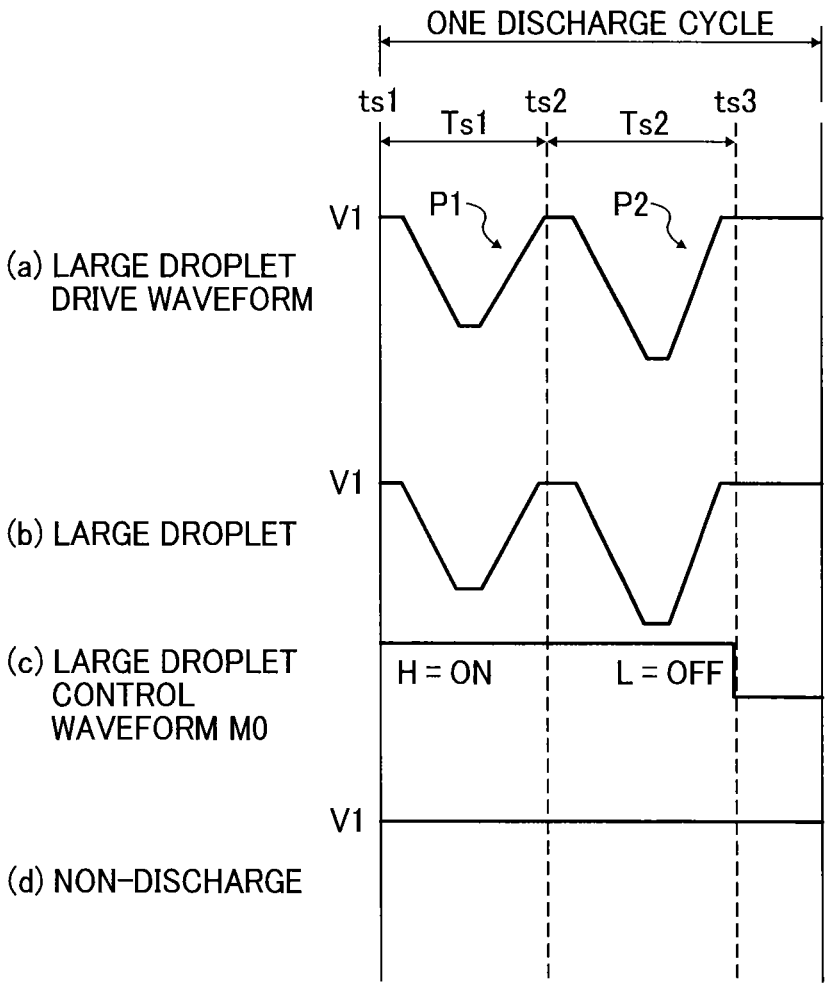
FIG. 6 is a chart illustrating a method for driving a background forming recording head according to an embodiment of the present invention.

As shown by a line chart (a) in FIG. 6, a drive waveform includes two pulses P1 and P2 for forming large droplets within one discharge cycle. When discharging large droplets, a large droplet control signal M0 is output, as shown by line charts (b) and (c) in FIG. 6.

Since the background forming recording head 40*b* only needs to discharge large droplets, the drive waveform for the background forming recording head 40*b* can be more simplified than that for the image forming recording head 40*a*. In addition, the discharge cycle of the background forming recording head 40*b* can be more shortened than that of the image forming recording head 40*a*. Accordingly, the background forming recording head 40*b* can be driven at a higher frequency than that for driving the image forming recording head 40*a*. The waveforms shown in FIGS. 5 and 6 are for illustration purpose and not limited thereto.

Since the background forming nozzle array is short in the sub-scanning direction, the carriage can be decreased in size in the sub-scanning direction. Further, the platen can be decreased in size in the sub-scanning direction, thus making the apparatus more compact.

Operation 4

In the embodiment described below, the nozzle configuration is the same as that illustrated in FIG. 3.

In the embodiment described below, image forming ink droplets are set larger than background forming ink droplets in size. Even when a background formed by the background forming recording head on a recording medium has a smaller dot density than an image formed by the image forming recording head on a recording medium, the background solid image can be sufficiently filled with dots.

Figure 7:
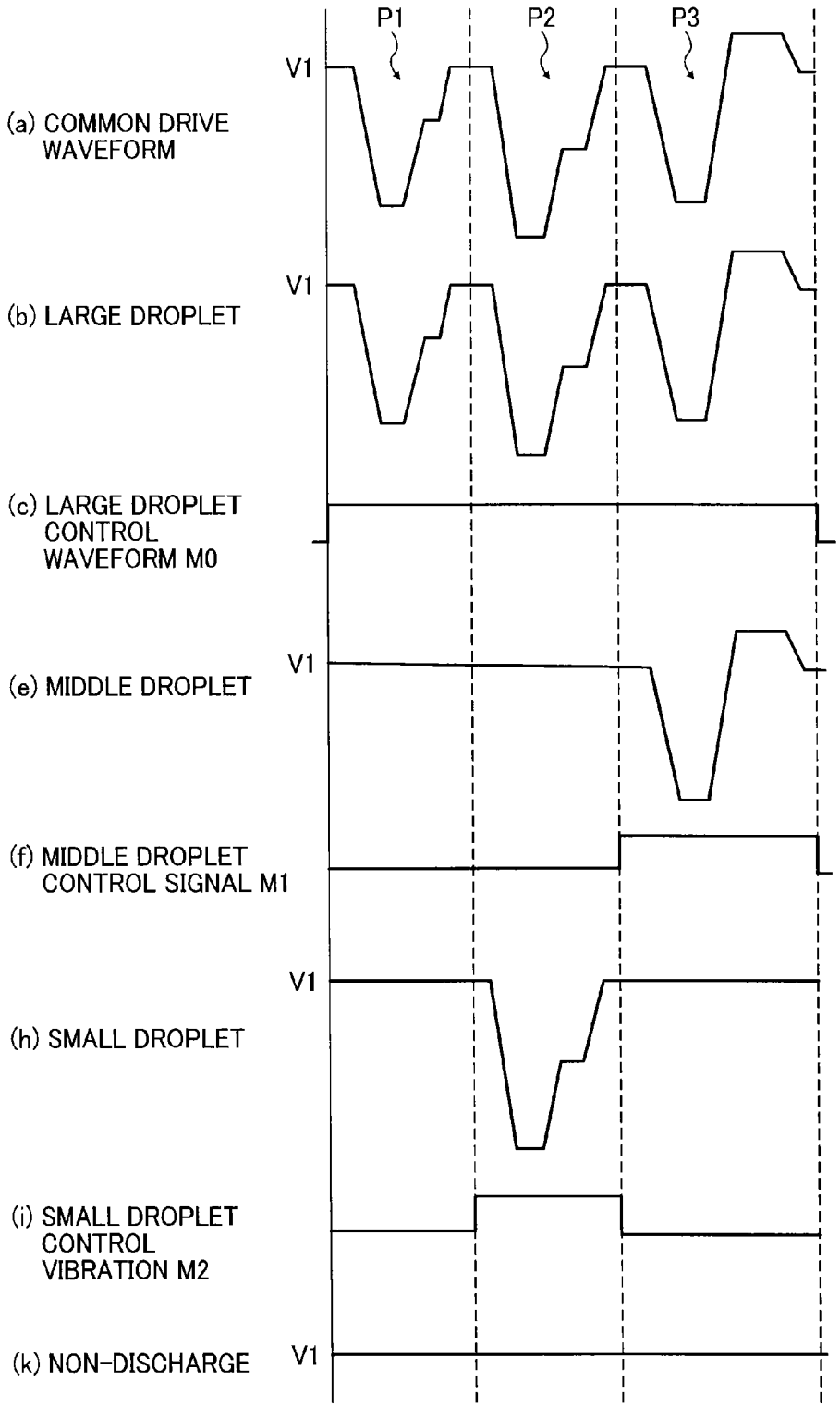
FIG. 7 is a chart illustrating a method for driving an image forming recording head according to an embodiment of the present invention.
Figure 8:
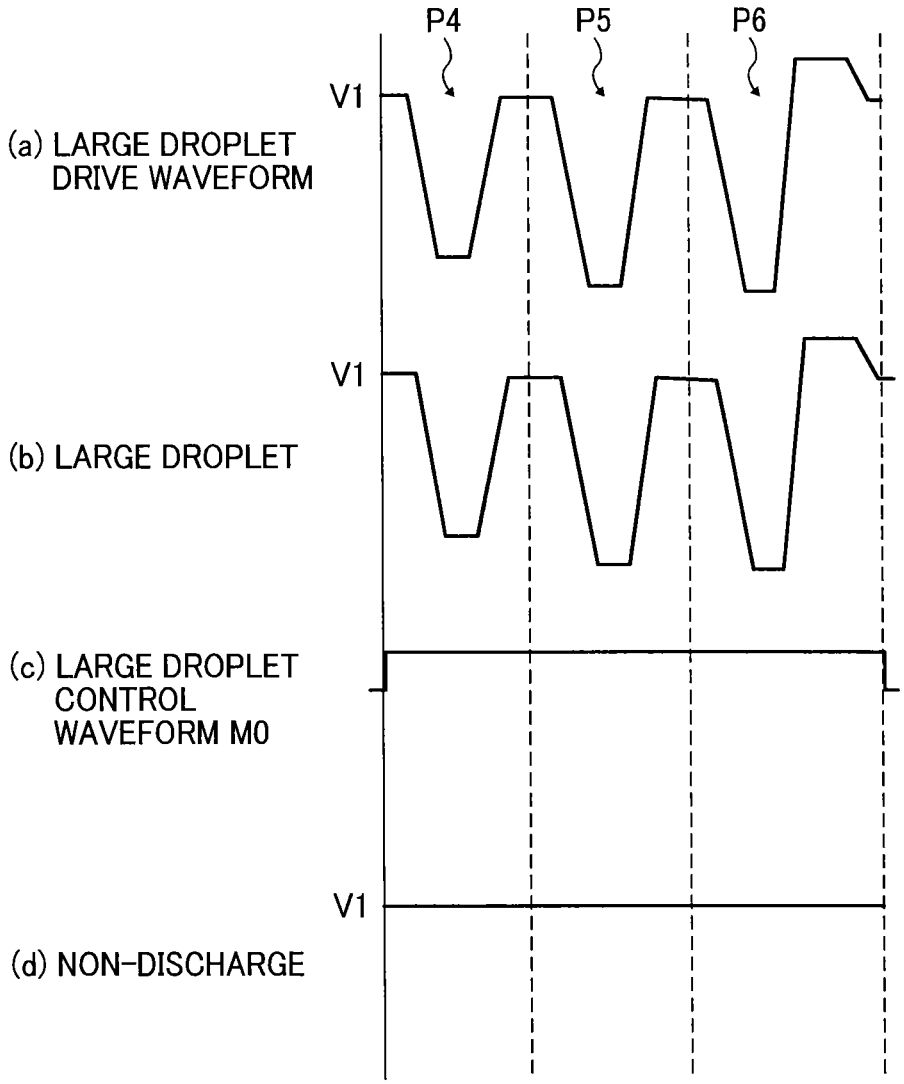
FIG. 8 is a chart illustrating a method for driving a background forming recording head according to an embodiment of the present invention.

FIGS. 7 and 8 are charts illustrating drive waveforms according to the present embodiment.

In the present embodiment, the drive frequency for the image forming recording head and that for the background forming recording head are the same, but the large droplet discharged from the background forming recording head is set larger than that discharged from the image forming recording head in size.

The pulses P1, P2, and P3 each cause each nozzle to discharge one droplet, and the discharged three droplets coalesce with each other while flying to become a large droplet. The waveform element of the P3 causes each nozzle to discharge a middle droplet. The fallen potential in the waveform element of the pulse P2 is set lower than that in the waveform element of the pulse P1, and the potential is risen up in a stepwise manner in the waveform element of the pulse P2, so that the pulse P2 alone can cause each nozzle to discharge a small droplet.

When discharging large droplets, the drive waveform generator outputs a large droplet control signal M0 that becomes a high level within intervals corresponding to the pulses P1, P2, and P3, as shown by line charts (b) and (c) in FIG. 7. When discharging middle droplets, a middle droplet control signal M1 that becomes a high level within the interval corresponding to the pulse P3 is output, as shown by line charts (e) and (f) in FIG. 7. When discharging small droplets, a small droplet control signal M2 that becomes a high level within the interval corresponding to the pulse P2 is output, as shown by line charts (h) and (i) in FIG. 7.

Next, a method for driving the background forming recording head 40*b* is described in detail with reference to FIG. 8.

As shown by a line chart (a) in FIG. 8, a drive waveform includes three pulses P4, P5, and P6 for forming large droplets within one discharge cycle. When discharging large droplets, a large droplet control signal M0 is output, as shown by line charts (b) and (c) in FIG. 8. This drive waveform is so designed that only large droplets are discharged. Specifically, the drive waveform is so designed that the pulses P4, P5, and P6 cause a greater potential difference after the potential has risen up than the pulses P1, P2, and P3 for the image forming recording head 40*a* do, and that the potential never rises up in a stepwise manner. Thus, the ink droplets formed by the pulses P4, P5, and P6 are larger than those formed by the pulses P1, P2, and P3 in terms of size. The large droplet formed by coalescence of three droplets formed by the pulses P4, P5, and P6 is larger than the large droplet formed by the image forming recording head 40*a*.

Since the background forming nozzle array needs not discharge small ink droplets, the nozzle diameter thereof can be more increased in size than that of the image forming nozzle array.

Since the background needs not to be high-definition and/or halftone, the image quality of the background never deteriorates even when the background is formed with large droplets with a small dot density.

Operation 5

Figure 9:
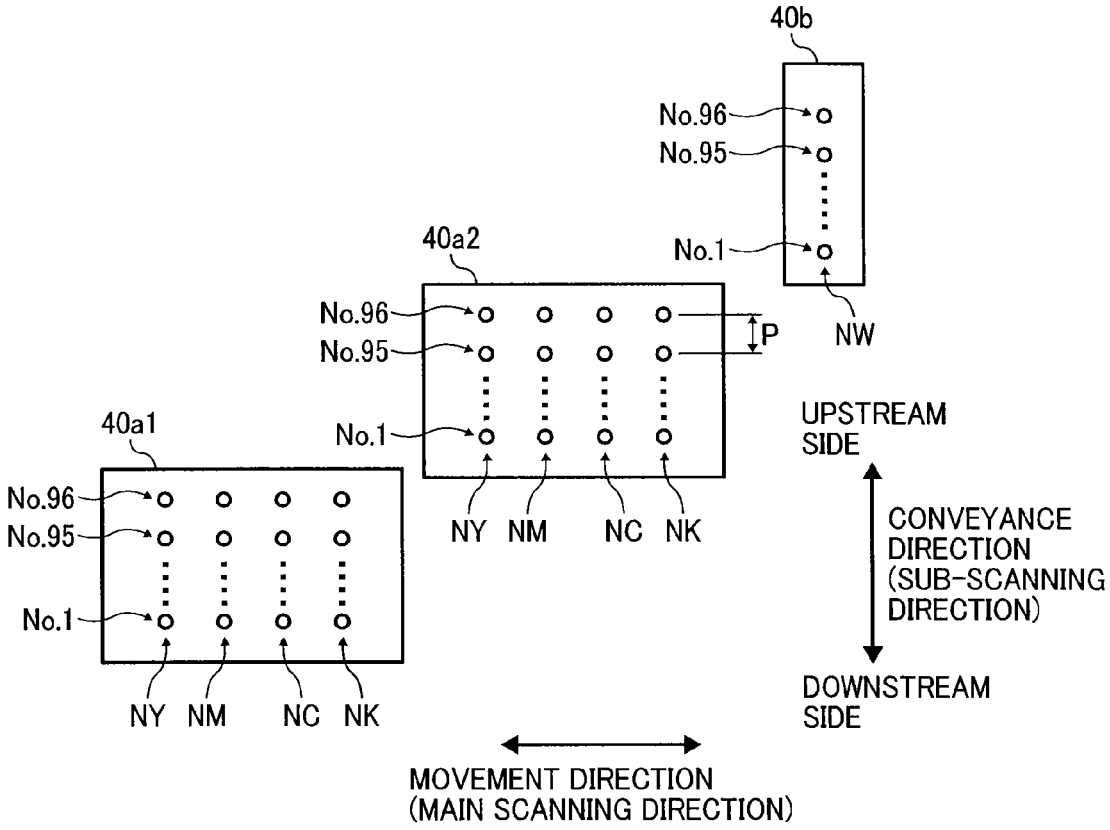
FIGS. 9 to 16 are illustrations for explaining the nozzle configurations of recording heads according to some embodiments of the present invention.
Figure 10:
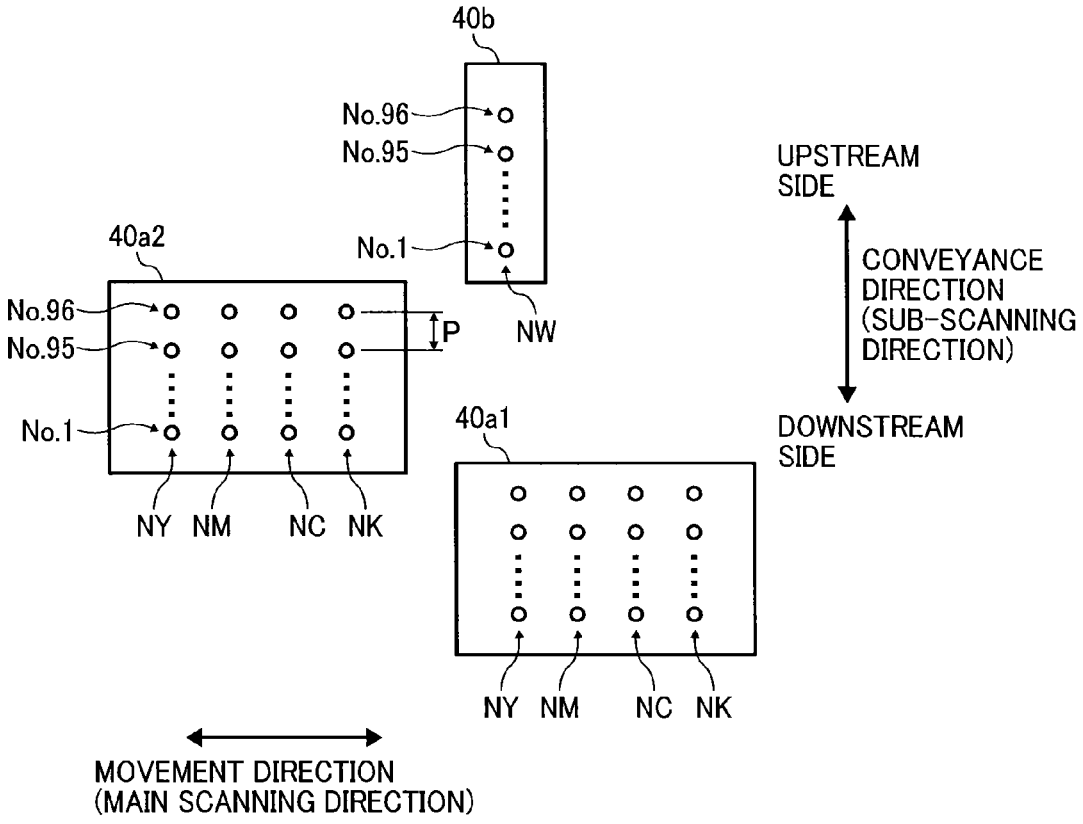

FIGS. 9 and 10 are illustrations for explaining the nozzle configurations of other recording heads according to some embodiments of the present invention.

In the embodiments illustrated in FIGS. 9 and 10, the image forming recording head 40*a* illustrated in FIG. 3 is replaced with two image forming recording heads 40*a*1 and 40*a*2.

Each of the image forming recording heads 40*a*1 and 40*a*2 includes multiple nozzle arrays (e.g., NY, NM, NC, NK) each including 96 nozzles numbered from 1 to 96. Therefore, each nozzle array (e.g., NY, NM, NC, NK) includes 192 nozzles in total (i.e., in the image forming recording heads 40*a*1 and 40*a*2). The background forming nozzle array is shorter than the image forming nozzle array in the sub-scanning direction. Specifically, the length of the background forming nozzle array is half that of the image forming nozzle array in the sub-scanning direction.

Operation 6

Figure 11:
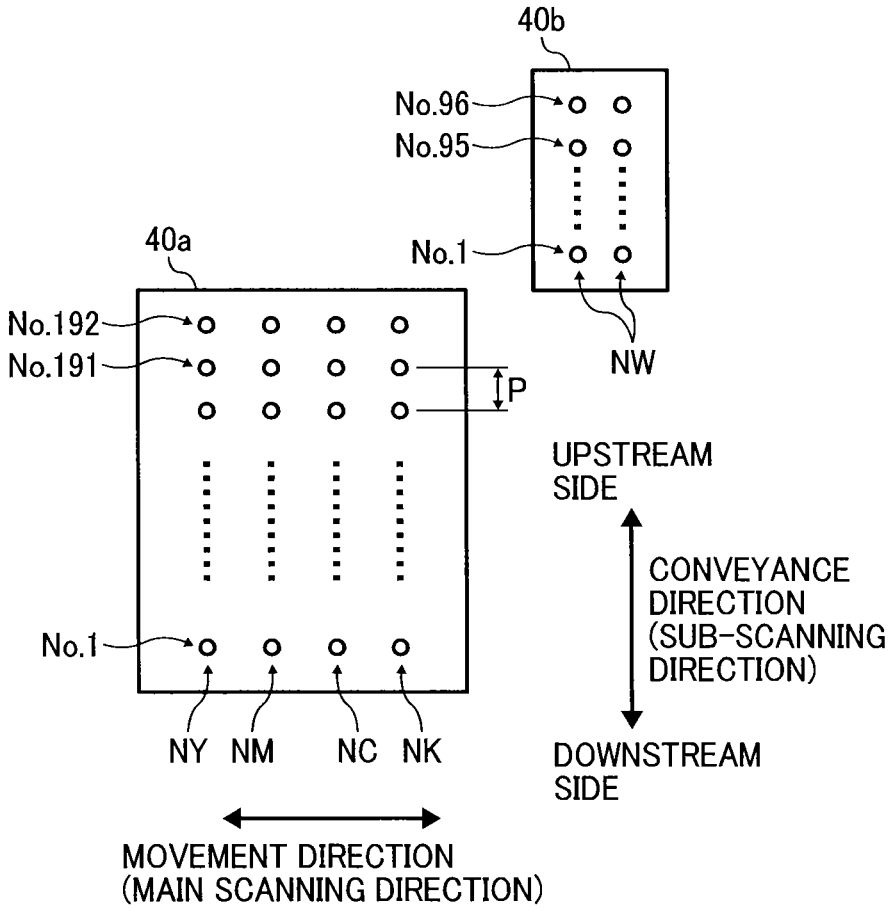

FIG. 11 is an illustration for explaining the nozzle configuration of another recording head according to some embodiments of the present invention.

In the embodiment illustrated in FIG. 11, two background forming nozzle arrays are provided. Similar to the embodiments illustrated in FIGS. 3 and 4, when the image forming nozzle array forms an image under the condition of 4 passes, ¼ interlace, and 16 scans, the background forming nozzle array forms a background under the condition of 2 passes, ¼ interlace, and 8 scans. Since two background forming nozzle arrays are provided, a background solid image can be produced without increasing the discharge frequency, unlike the case for FIGS. 3 and 4. Thus, the drive waveform generator for the background forming nozzle array and that for the image forming nozzle array can share a common design.

Operation 7

Figure 12:
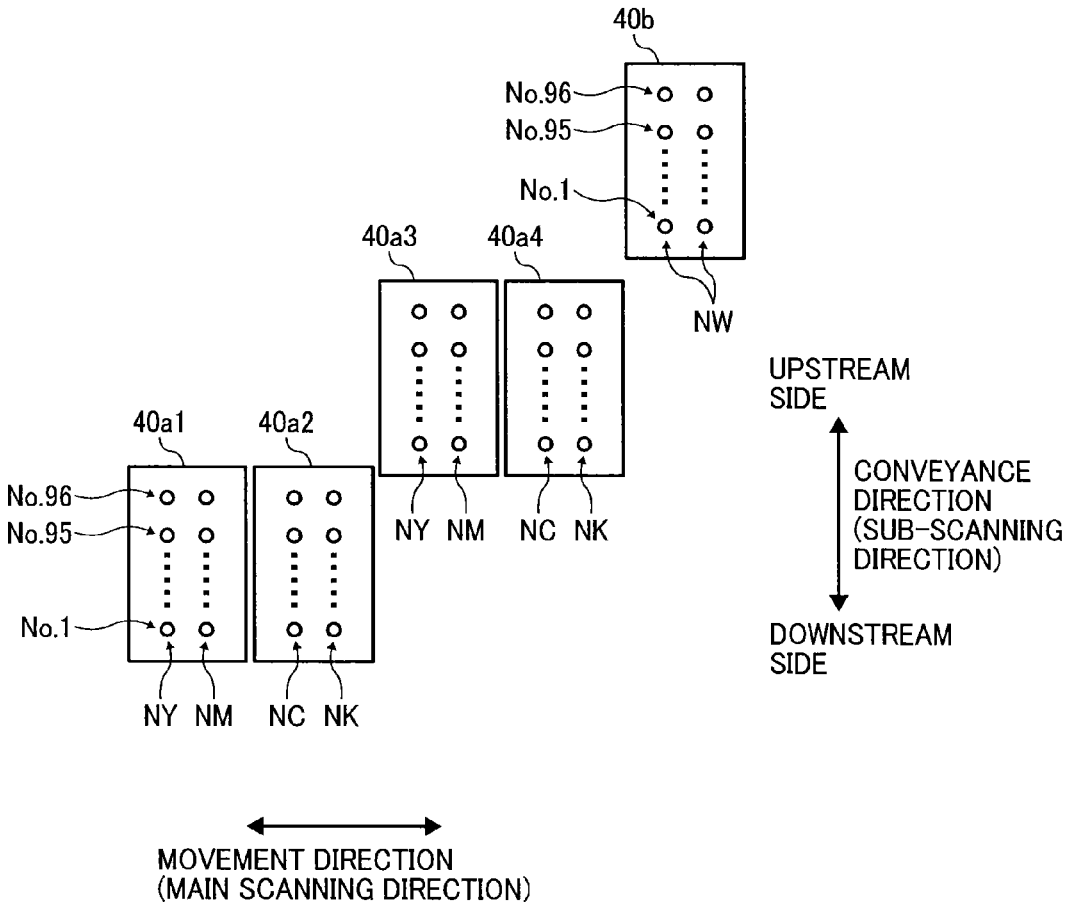
Figure 13:
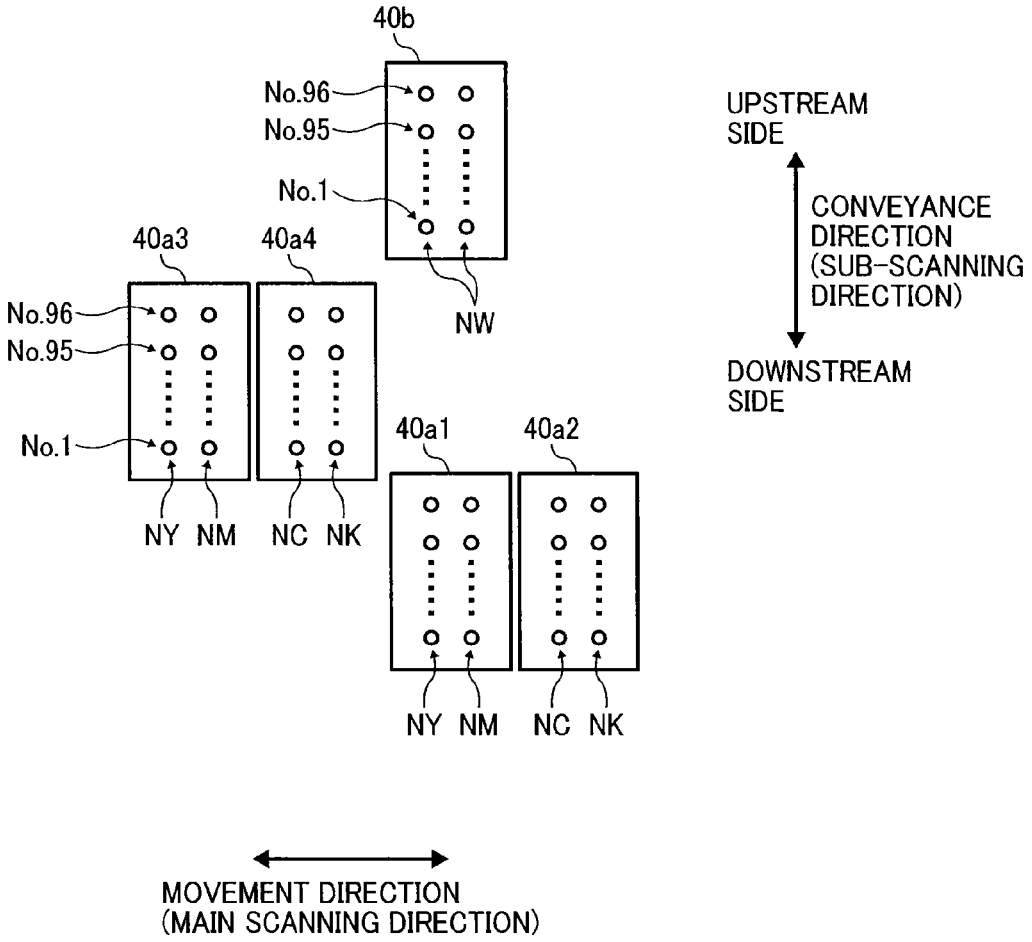

FIGS. 12 and 13 are illustrations for explaining the nozzle configurations of other recording heads according to some embodiments of the present invention.

In the embodiments illustrated in FIGS. 12 and 13, the image forming recording head 40*a* illustrated in FIG. 11 is replaced with four image forming recording heads 40*a*1, 40*a*2, 40*a*3, and 40*a*4. Each of the image forming recording heads 40*a*1, 40*a*2, 40*a*3, and 40*a*4 includes multiple nozzle arrays (e.g., NY, NM, NC, NK) each including 96 nozzles numbered from 1 to 96. Therefore, each nozzle array (e.g., NY, NM, NC, NK) includes 192 nozzles in total (i.e., in the image forming recording heads 40*a*1 and 40*a*3, or in the image forming recording heads 40*a*2 and 40*a*4). The background forming nozzle array is shorter than the image forming nozzle array in the sub-scanning direction. Specifically, the length of the background forming nozzle array is half that of the image forming nozzle array in the sub-scanning direction. The image forming recording heads 40*a*1, 40*a*2, 40*a*3, and 40*a*4 and the background forming recording head 40*b* include the same number of nozzles and the same number of nozzle arrays. Therefore, these recording heads can share common parts, resulting in cost reduction.

As technologies for printing an image on a transparent recording medium, surface printing and back printing are known. In surface printing, a background solid image is printed on a surface of the recording medium with a background forming ink (e.g., white ink) first, and then an image is printed on the background solid image. In back printing, an image is printed on a surface of the recording medium first, and then a background solid image is printed on the image with a background forming ink. In each printing technologies, a white ink layer and color ink layers are superimposed on one another. The above-described embodiments are examples of surface printing.

Operation 8

Figure 14:
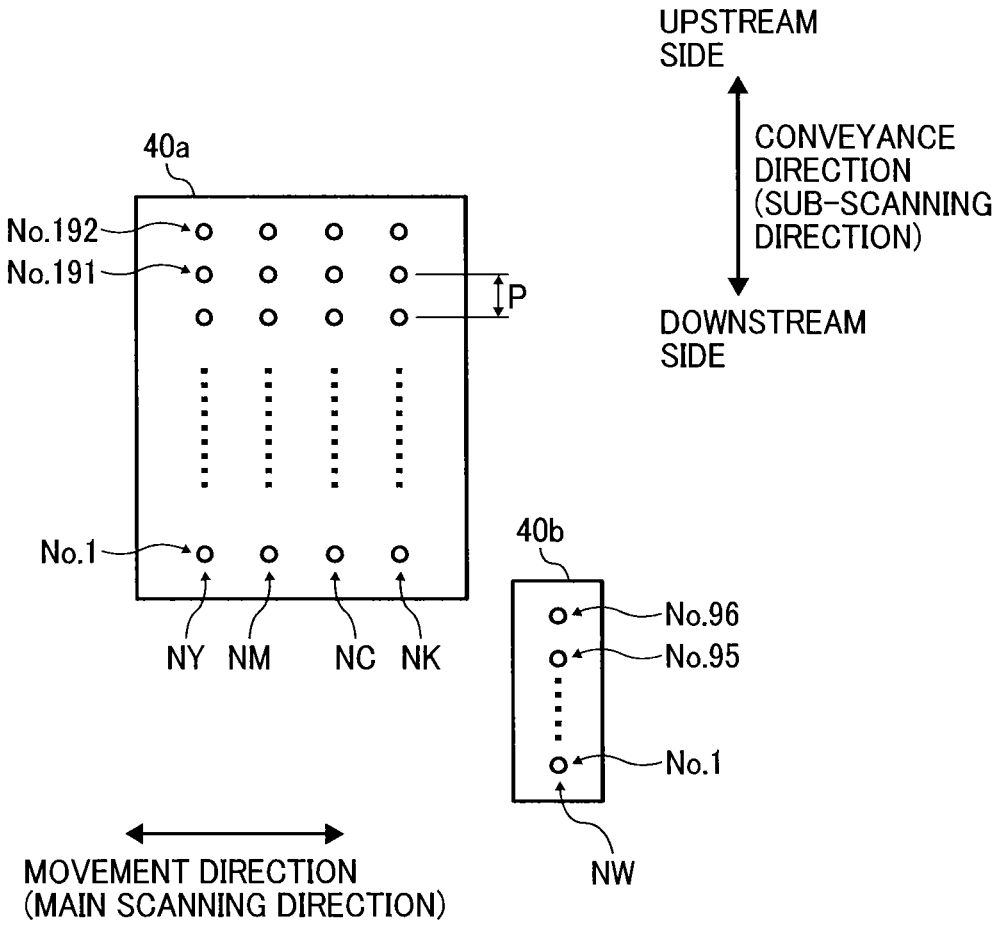
Figure 15:
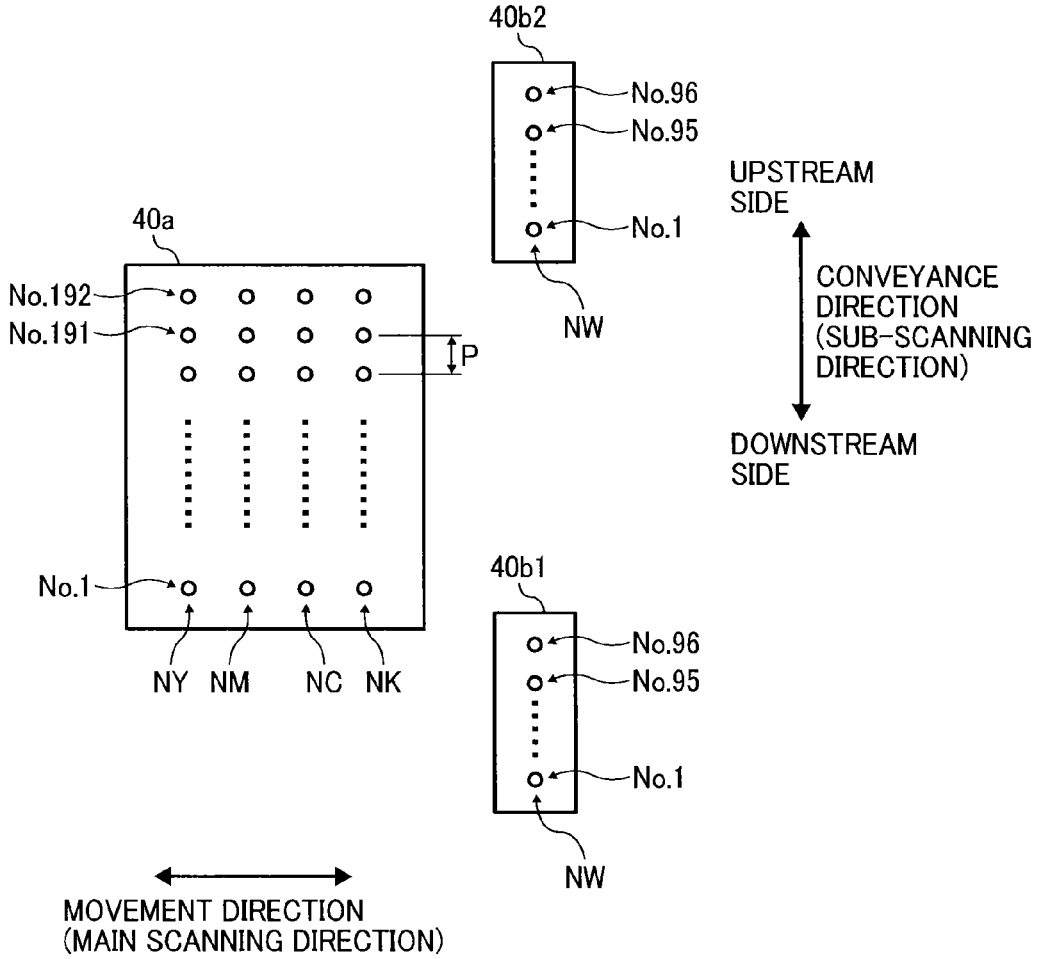

FIG. 14 is an illustration for explaining the nozzle configuration of another recording head according to some embodiments of the present invention, applicable to back printing.

In the embodiment illustrated in FIG. 14, the background forming recording head 40*b* is disposed downstream form the image forming recording head 40*a* relative to the conveyance direction (sub-scanning direction). This configuration makes it possible that the background forming recording head forms a white solid image on an image having been formed by the image forming recording head. When the image is printed on a transparent recording medium, the image is visible from the non-printed surface side of the recording medium.

The present embodiment is applicable to a case in which a transparent liquid is to be coated on an image for improving fastness of the image, as the white ink to be discharged from the nozzle arrays in the background forming recording head is replaced with the transparent liquid.

Operation 9

FIG. 14 is an illustration for explaining the nozzle configuration of another recording head according to some embodiments of the present invention, applicable to both surface printing and back printing. In the case of surface printing, the image forming recording head 40*a* and a background forming recording head 40*b*2 are put into operation. In the case of back printing, the image forming recording head 40*a* and a background forming recording head 40*b*1 are put into operation.

Operation 10

Figure 16:
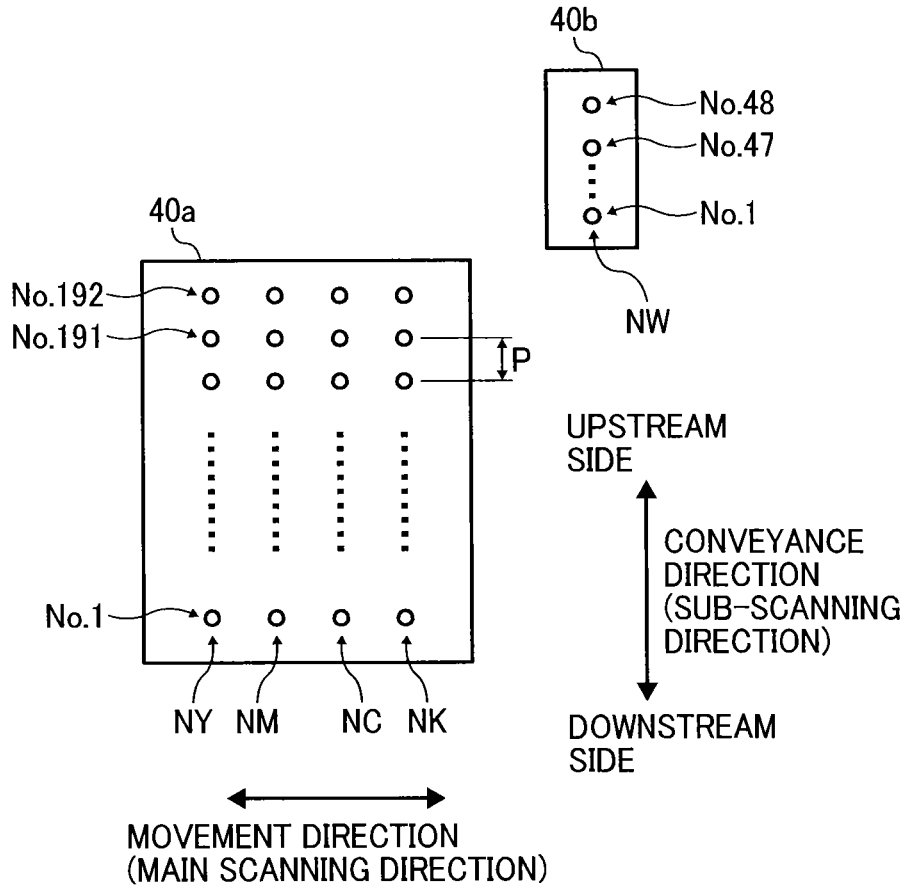

FIG. 16 is an illustration for explaining the nozzle configuration of another recording head according to some embodiments of the present invention.

In the embodiment illustrated in FIG. 16, the length of the background forming nozzle array NW is one-quarter of the length of each of the image forming nozzle arrays NY, NM, NC, and NK.

Each nozzle array in the image forming recording head 40*a* includes 192 nozzles, numbered from 1 to 192. The background forming recording head 40*b* includes one background forming nozzle array including 48 nozzles, numbered from 1 to 48.

When the image forming nozzle array forms an image under the condition of 4 passes, ¼ interlace, and 16 scans, the background forming nozzle array forms a background under the condition of 2 passes, ¼ interlace, and 8 scans. Since the number of passes is smaller, the background forming nozzle array is driven at a higher frequency and/or droplets discharged from the background forming nozzle array is increased in size, so that a background solid image is reliably formed.

Operation 11

In the embodiment described below, an ink discharge region is selected from the image forming recording head 40*a* according to a selected recording mode. Ink is discharged from the ink discharge region to form an image.

Examples of the recording mode include the following.

Normal Mode: Only an image is formed with image forming inks on a recording medium.

Surface Printing Mode: A background solid image is formed with a background forming ink (e.g., white ink) on a surface of a recording medium first, and then an image is formed with image forming inks on the background solid image.

Back Printing Mode: An image is formed with image forming inks on a surface of a recording medium first, and then a background solid image is formed with a background forming ink (e.g., white ink) on the image.

How to select the ink discharge region in each recording mode is described in detail below.

Figure 17A:
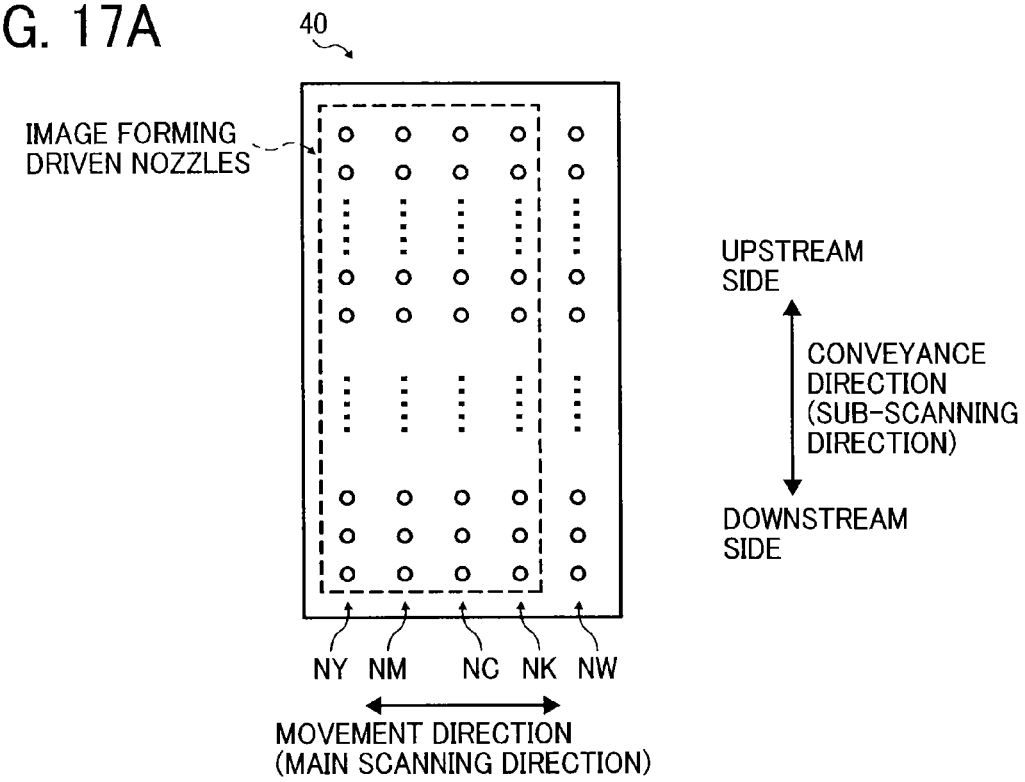
FIGS. 17A to 17C are illustrations for explaining the nozzle configuration of a recording head according to some embodiments of the present invention.
Figure 17B:
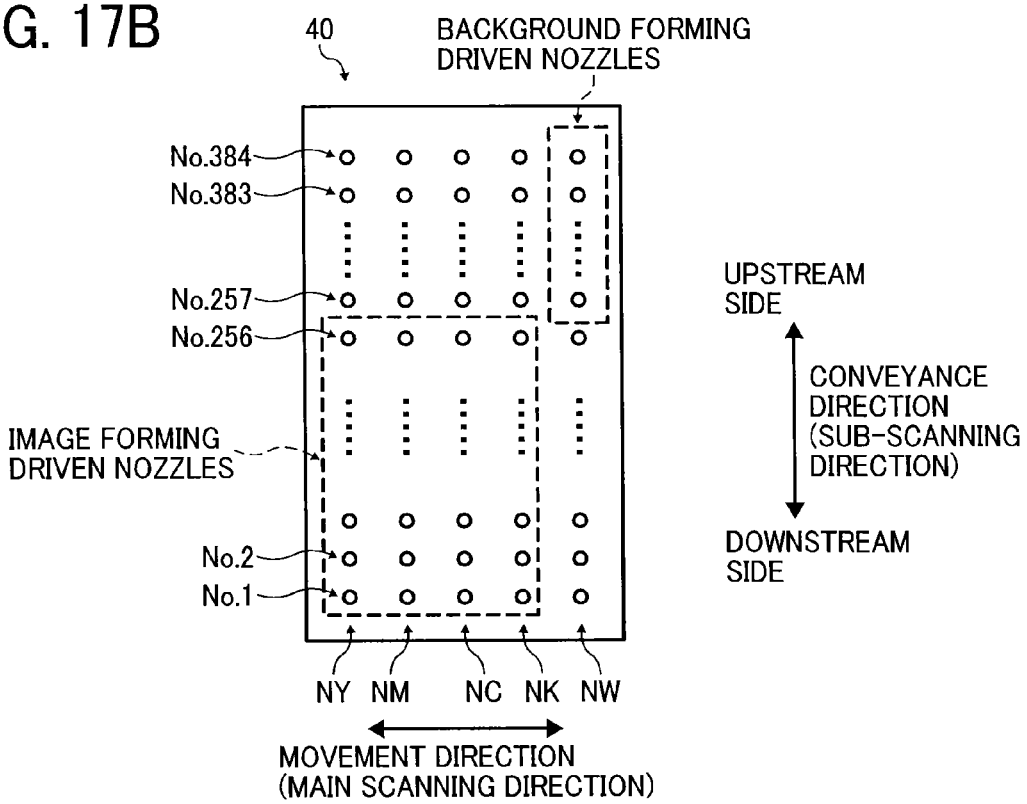
Figure 17C:
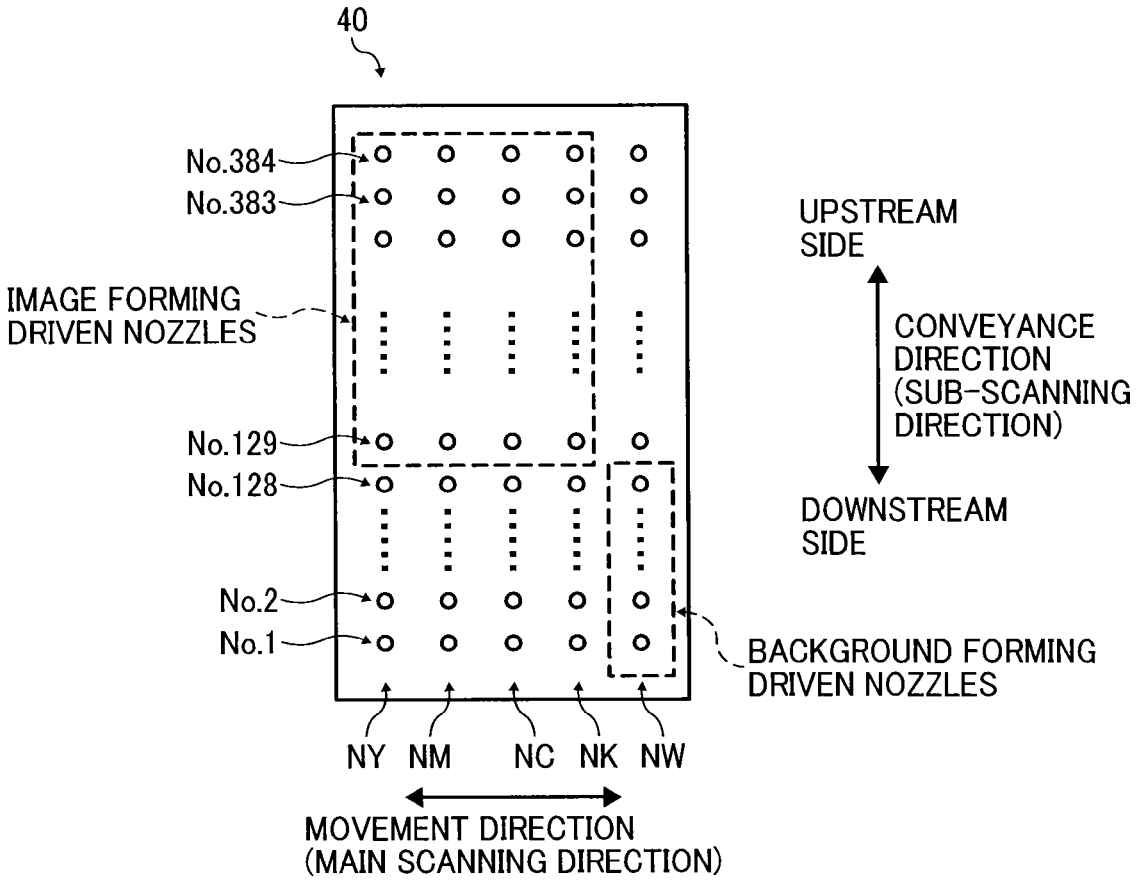
Figure 18:
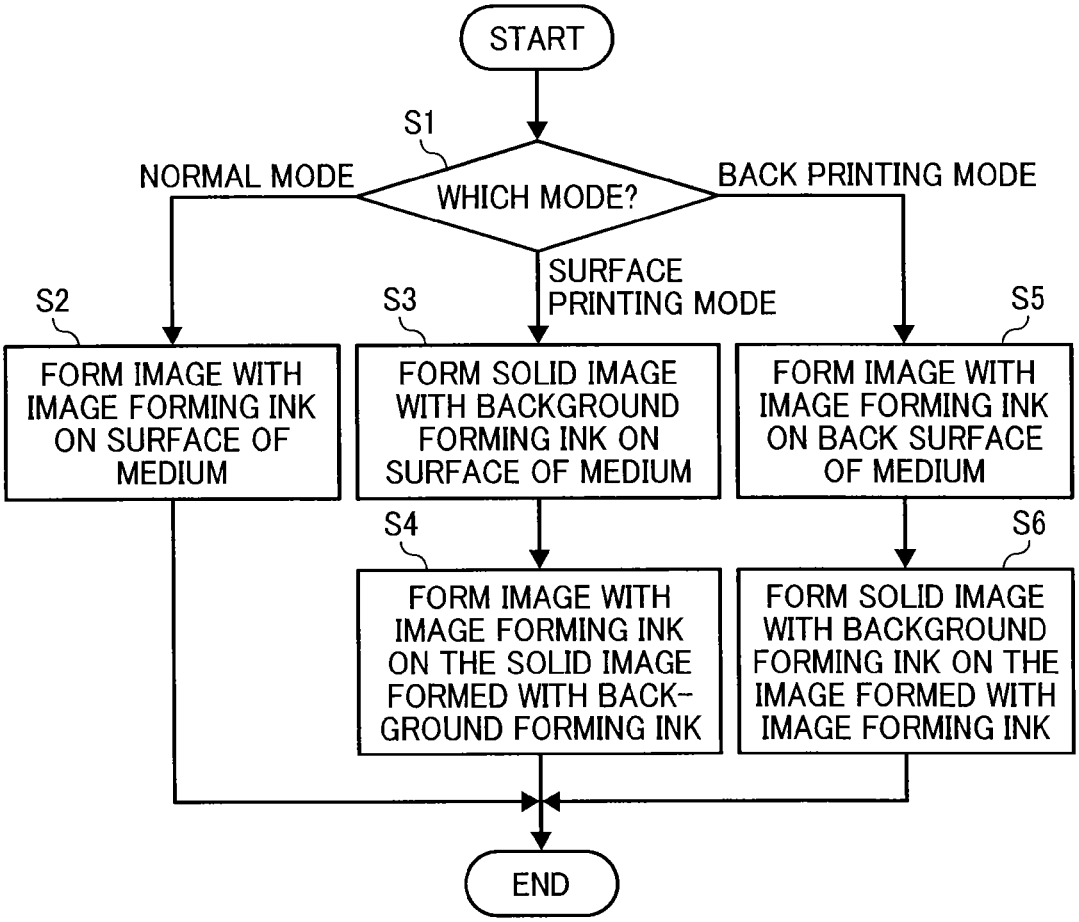
FIG. 18 is a flowchart showing an operation of the image forming apparatus illustrated in FIG. 1.

FIGS. 17A to 17C are illustrations for explaining the nozzle configuration of another recording head according to some embodiments of the present invention. In this recording head, the image forming nozzle arrays NY, NM, NC, and NK and the background forming nozzle array NW are arranged in parallel with each other. Each nozzle array includes 384 nozzles, numbered from 1 to 384. FIG. 18 is a flowchart of an operation of the image forming apparatus illustrated in FIG. 1.

In the normal mode, as illustrated in FIG. 17A, the ink discharge region (surrounded by dashed lines) is so selected that all the nozzles (from No. 1 to No. 384) in all the image forming nozzle arrays NY, NM, NC, and NK are included therein. In the normal mode, a background forming (e.g., white ink) can be used as an image forming ink. Even in this case, the image forming nozzle arrays are used for forming an image with the background forming (e.g., white ink), not for forming a background.

In the surface printing mode, as illustrated in FIG. 17B, the ink discharge region (surrounded by dashed lines) is so selected that the nozzles No. 1 to No. 256 in all the image forming nozzle arrays NY, NM, NC, and NK and the nozzles No. 257 to No. 384 in the background forming nozzle array NW are included therein. In the back printing mode, as illustrated in FIG. 17C, the ink discharge region (surrounded by dashed lines) is so selected that the nozzles No. 129 to No. 384 in all the image forming nozzle arrays NY, NM, NC, and NK and the nozzles No. 1 to No. 128 in the background forming nozzle array NW are included therein.

Referring to FIG. 18, once a print operation is started, it is determined that which recording mode has been selected (S1). When it is determined that the normal mode has been selected (S1/normal mode), an image is formed with an image forming ink on a surface of a recording medium (S2). When it is determined that the surface printing mode has been selected (S1/surface printing mode), a solid image is formed with a background forming ink on a surface of a recoding medium (S3). An image is then formed with an image forming ink on the solid image formed with the background forming ink (S4). When it is determined that the back printing mode has been selected (S1/back printing mode), an image is formed with an image forming ink on a back surface of a recording medium (S5). A solid image is then formed with a background forming ink (e.g., white ink) on the image formed with the image forming ink (S6).

Thus, the recording head according to the present embodiment can respond to either the normal mode, surface printing mode, or back printing mode. In the normal mode, the printing speed increases since a large number of nozzles is driven.

In the above-described embodiments, an ink which is fixable on a recording medium as being dried and hardened by application of heat from a heater is used. Alternatively, another type of ink can also be used which is curable by emission of radial ray (e.g., ultraviolet).

In this case, the image forming apparatus may be an inkjet recording apparatus having the following configuration. Namely, the inkjet recording apparatus includes guide rods and a carriage supported by the guide rods. The carriage reciprocates along the guide rods in the main scanning direction.

The carriage includes a recording head. On both sides of the recording head, ultraviolet emitters are disposed for emitting ultraviolet to ink discharged onto a recording medium. Ink droplets discharged from the recording head and impacted on the recording medium are successively irradiated with ultraviolet emitted from the ultraviolet emitters, thus being cured and fixed on the recording medium.

In the above-described embodiments, the background forming ink is not limited to white ink. Other than white ink, metallic inks (e.g., silver ink, gold ink), pre-application liquids for reducing image blurring or improving adhesion to recording media, and clear inks to be applied on images for protection can be treated as the background forming ink.

Examples of the image forming ink generally include black ink. However, the image forming inks can be limited to colored inks, excluding black ink. Examples of the image forming ink further include light inks (e.g., light cyan ink, light magenta ink) and special color inks (e.g., orange ink, green ink, red ink) other than three-primary-color (cyan, magenta, yellow) inks.

In accordance with some embodiments of the present invention, the background forming nozzle array for discharging a background forming ink (e.g., white ink) is shorter than the image forming nozzle array in the longitudinal direction. This makes it possible to decrease the carriage in size in the sub-scanning direction, in the case of employing the background forming ink (e.g., white ink). Further, the platen can be decreased in size in the sub-scanning direction, thus making the apparatus more compact.

The above-described image forming apparatus according to some embodiments of the present invention can be implemented by a program which causes a computer to perform a process.

Specifically, the program may be a computer-readable program which causes a computer to perform an image forming method including: scanning a recording head which includes an image forming nozzle array for discharging an image forming ink and a background forming nozzle array for discharging a background forming ink, in the main scanning direction and the sub-scanning direction relative to a recording medium; discharging the image forming ink from the image forming nozzle array to form an image on the recording medium, when a normal mode is selected; discharging the background forming ink from the background forming nozzle array to form a background solid image on a surface of the recording medium and then discharging the image forming ink from the image forming nozzle array to form an image on the background solid image, when a surface printing mode is selected; and discharging the image forming ink from the image forming nozzle array to form an image on a back surface of the recording medium and then discharging the background forming ink (e.g., white ink) from the background forming nozzle array to form a background (white) solid image on the image, when a back printing mode is selected.

The program may be stored in a computer-readable memory.

The program may be stored in a memory, such as a computer-readable memory (e.g., compact disc read only memory (CD-ROM), flexible disk (FD), CD recordable (CD-R)), a semiconductor memory (e.g., flash memory, RAM, ROM, ferroelectric RAM (FeRAM)), and a hard disc drive (HDD).

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

What is claimed is:

1. An image forming apparatus, comprising:

a recording head to discharge a liquid on a recording medium while scanning in a main scanning direction and a sub-scanning direction relative to the recording medium, the recording head including:

a first nozzle array; and a second nozzle array, the second nozzle array being shorter than the first nozzle array in the longitudinal direction and disposed not overlapped with the first nozzle array in the main scanning direction; and control circuitry configured to cause the first nozzle array to discharge the liquid in a first discharge amount per unit time per unit length in a longitudinal direction, and cause the second nozzle array to discharge the liquid in a second discharge amount per unit time per unit length in the longitudinal direction, wherein the second discharge amount is larger than the first discharge amount.

2. The image forming apparatus of claim 1, wherein the control circuitry is further configured to cause the first nozzle array and the second nozzle array to discharge the liquid at a first discharge frequency and a second discharge frequency, respectively, and the second discharge frequency is larger than the first discharge frequency.

3. The image forming apparatus of claim 1, wherein the control circuitry is further configured to cause the first nozzle array and the second nozzle array to discharge a first droplet and a second droplet, respectively, of the liquid, and the second droplet is larger than the first droplet in size.

4. The image forming apparatus of claim 1, wherein the first nozzle array is an image forming nozzle array and the control circuitry is further configured to cause the first nozzle array to discharge an image forming ink to be used for forming an image, and the second nozzle array is a background forming nozzle array and the control circuitry is further configured to cause the second nozzle array to discharge a background forming ink to be used for forming a background.

5. The image forming apparatus of claim 4, wherein a number of nozzles in the image forming nozzle array used for discharging one type of image forming ink is larger than a number of nozzles in the background forming nozzle array used for discharging one type of background forming ink.

6. The image forming apparatus of claim 4, wherein the recording head includes:

a plurality of image forming recording heads arranged in the sub-scanning direction, each including the image forming nozzle array; and at least one background forming recording head including the background forming nozzle array, wherein a total number of nozzles in the image forming nozzle array is a same as the total number of nozzles in the background nozzle array, and wherein a number of the at least one background forming recording head arranged in the sub-scanning direction is smaller than a number of the image forming recording heads arranged in the sub-scanning direction.

7. The image forming apparatus of claim 4, wherein the image forming nozzle array and the background forming nozzle array are disposed in parallel in the sub-scanning direction, and wherein the image forming apparatus selects which nozzles in the image forming nozzle array and the background forming nozzle array to discharge the liquid, according to a selected recording mode.

* * * * *